US005717980A

United States Patent [19]

Oka et al.

[11] Patent Number: 5,717,980

[45] Date of Patent: Feb. 10, 1998

[54] IMAGE FORMING DEVICE WITH TRANSFER UNIT

[75] Inventors: Takeki Oka, Toyohashi; Makoto Shimazoe, Toyokawa; Munenori Nakano; Hirohisa Shirai, both of Aichi-ken, all of Japan

[73] Assignee: Minolta Co., Ltd., Osaka, Japan

[21] Appl. No.: 747,011

[22] Filed: Nov. 7, 1996

[30] Foreign Application Priority Data

Nov. 10, 1995 [JP] Japan ..... 7-292928

[51] Int. Cl.[6] ..... G03G 15/16

[52] U.S. Cl. ..... 399/66; 399/316

[58] Field of Search ..... 399/66, 316, 88; 361/235

[56] References Cited

U.S. PATENT DOCUMENTS 4,055,380 10/1977 Borostyan .
4,077,709 3/1978 Borostyan et al. .

FOREIGN PATENT DOCUMENTS 59-104677 6/1984 Japan .
61-32667 B 7/1986 Japan .
4-23789 B 4/1992 Japan .
4-58031 B 9/1992 Japan .
6-35289 2/1994 Japan .
7-84469 3/1995 Japan .
7-234593 9/1995 Japan .

*Primary Examiner*—Joan H. Pendergrass
*Attorney, Agent, or Firm*—Burns, Doane, Swecker & Mathis, LLP

[57] ABSTRACT

An image forming device having a transfer unit that transfers the toner image formed on the image carrier onto transfer paper, such that the toner image can be transferred with good results regardless of fluctuations in the environment, by (a) returning to the feedback side of the power source, via a constant voltage element, part of the electric current that flows to (i) the transfer unit, to which a prescribed voltage is applied by the power source, and (ii) the guide member that supports the transfer paper, said electric current flowing to said guide member via said transfer paper, and by (b) controlling the voltage of the power source such that the voltage on the feedback side of the power source will be constant.

8 Claims, 5 Drawing Sheets

IMAGE FORMING DEVICE WITH TRANSFER UNIT

BACKGROUND OF THE INVENTION

1. Field of the Invention

The present invention pertains to an image forming device, and more particularly, to an image forming device based on the electrophotographic method that transfers a toner image formed on an image carrier onto a transfer medium.

2. Description of the Related Art

In the toner image transfer process used in an electrophotographic copy machine, there is one generally observed inconvenience that the transfer charge leaks onto the toner on the image carrier (i.e., the photosensitive drum) and a defect in the transfer occurs. To combat this problem, the following methods have conventionally been proposed: (a) a method in which the guide plate or guide roller that guides the transfer medium to the transfer position is grounded via a resistor, as disclosed in U.S. Pat. No. 4,055,380; and (b) a method in which voltage is applied to the guide plate or guide roller that guides the transfer medium to the transfer position, as disclosed in Japanese Published Patent Application Sho 61-32667 and Japanese Published Patent Application Hei 4-58031. Other proposed methods include (c) a method in which the voltage applied to the charging wire is feedback-controlled in accordance with the amount of electric current that flows to the shielding plate of the transfer charger, as disclosed in U.S. Pat. No. 4,077,709, and (d) a method in which a Zener diode is inserted between the transfer medium guide member and the feedback winding of the transfer power output transformer, as disclosed in Japanese Published Patent Application Hei 4-23789.

However, when using countermeasures (a) and (b) described above, when the resistance of the transfer medium becomes too low, the leakage of transfer current increases and therefore transfer defects cannot be reliably prevented. When using countermeasures (c) and (d), while the transfer current can be maintained at a constant level regardless of the resistance of the transfer medium, because there is no current leakage, conversely, the back side of the transfer medium will come to have a potential during high humidity that is equal to that during low humidity, and charge may leak in the direction of the thickness of the transfer medium immediately before transfer takes place. As a result, a transfer defect (a phenomenon in which the toner is not transferred and the image becomes blank) may occur.

OBJECT AND SUMMARY

The object of the present invention is to provide an image forming device that can transfer the toner image from the image carrier onto the transfer medium with good results regardless of fluctuations in the surrounding conditions, and in high humidity in particular.

In order to attain the object described above, the image forming device of the present invention that transfers the toner image formed on the image carrier onto the transfer medium that is placed in close contact with the image carrier is equipped with a guide member that guides the transfer medium toward the transfer position of the image carrier, a transfer electrode that gives charge the transfer medium guided to the transfer position, a power source that supplies power to the transfer electrode, and a feedback circuit that controls the output of the power source such that the amount of electric current obtained by excluding from the electric current that flows from the transfer electrode to the transfer medium the amount of electric current that flows to the guide member will be constant at all times, wherein said feedback circuit has a circuit that splits the electric current flowing from the guide member and routes it toward a grounded high resistance element and a constant voltage element connected to the feedback side of the power source.

In the construction described above, the leaked current that flows on the surface of the transfer medium toward the guide member flows toward the ground via the resistance element, so that the transfer current is controlled. When the resistance of the transfer medium decreases in high humidity and the leaked current becomes equal to or higher than a certain level, the constant voltage element receives electric current and the electric current is supplied to the feedback side of the power source. In other words, when the resistance of the transfer medium is reduced in high humidity, the constant voltage element operates to make the leaked current constant at a certain level. By turning the leaked current into a constant current, electric current excluding the leaked current is used for the transfer, so that the transfer current in high humidity becomes smaller than the reference level (the normal humidity level or low humidity level is deemed the reference). In other words, because the back side potential of the transfer medium decreases in high humidity and the potential of the guide member is maintained at a constant level, the potential gradient from the transfer medium back side to the guide member decreases. Therefore, the leakage of charge in the direction of the thickness of the transfer medium is prevented and transfer defects are eliminated.

The transfer unit described above also has a charging wire to which voltage is applied from the power source as well as a shielding plate to help the voltage applied to the charging wire to work effectively in the transfer of the toner image, and the feedback circuit has a circuit that connects the electric current flowing to the shielding plate with the feedback side of the power source. The voltage can be stabilized with further accuracy by means of this circuit.

Further, the feedback circuit has a comparator that compares the reference voltage with the voltage of the feedback side of the power source that fluctuates based on the electric current that flows toward the constant voltage element, which comprises one portion of the electric current flowing from the guide member and divided such that it flows into two routes, and controls the voltage applied by the power source based on the output from the comparator.

In addition, by changing the reference voltage input to the comparator, the transfer voltage applied at the transfer position is changed. By using a comparator and changing the reference voltage input to the comparator in accordance with the size of the paper, for example, as described above, more sophisticated control can be made possible.

In addition, a resistor or constant voltage element is inserted between the guide member and the bifurcation point of the feedback circuit.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 4(*b*) is a circuit diagram showing a modified version of the transfer control shown in FIGS. 2 and 3.

DETAILED DESCRIPTION OF THE PREFERRED EMBODIMENTS

Figure 1:
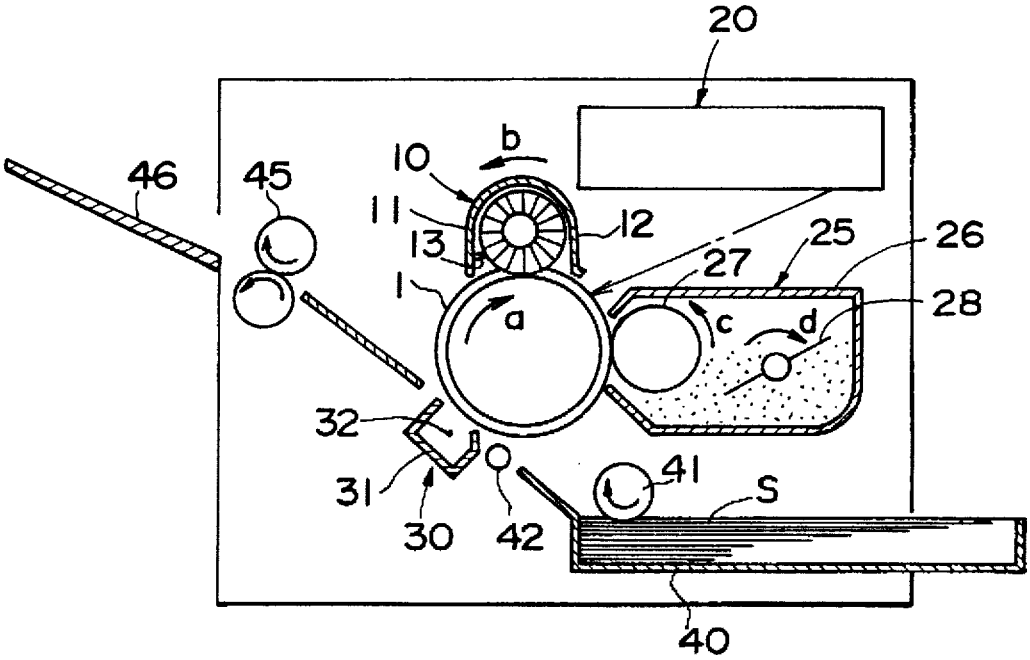
FIG. 1 is a schematic showing the construction of a laser printer, an embodiment pertaining to the present invention.

The embodiments of image forming device pertaining to the present invention are explained below with reference to the attached drawings. The embodiments explained below are laser printers in which the present invention is applied.

(Entire Construction of the Printer)

This laser printer comprises charger 10, laser scanning optical unit 20, developer unit 25 and transfer unit 30 placed around photosensitive drum 1 that is driven to rotate in the direction indicated by arrow a.

Charger 10 comprises charging brush 11 housed in casing 12 such that said brush may rotate in the direction indicated by arrow b. Charging brush 11 consists of a conductive shaft in which resin fibers including conductive particles are implanted. A DC voltage or switched DC voltage or alternating current (AC) overlaid on a DC voltage is applied to charging brush 11. An electrical discharge is caused at the tip of charging brush 11 by means of this application of voltage so that the surface of photosensitive drum 1 will become uniformly charged with a prescribed voltage to have a negative polarity.

Laser scanning optical unit 20 emits a laser beam in accordance with the image information received from the host computer. The laser beam scans and irradiates the surface of photosensitive drum 1 uniformly charged by charger 10 and forms an electrostatic latent image. This electrostatic latent image is a negative image in which the image area is attenuated to almost 0V.

Developer unit 25 comprises developing sleeve 27 placed in casing 26 housing a non-magnetic single-component toner such that said developing sleeve may rotate in the direction indicated by arrow c. The toner becomes negatively charged through friction because of the churning of churning blade 28 that rotates in the direction indicated by arrow d and is carried on the surface of developing sleeve 27 as it rotates. When this happens, a negative developing bias voltage is applied to developing sleeve 27 so that the toner will adhere to the low potential area (i.e., the image area) of the electrostatic latent image. In this way, the electrostatic latent image is made into a positive toner image.

Transfer unit 30 comprises shielding plate 31 and charging wire 32. A positive DC voltage is applied to charging wire 32 as described below.

Transfer paper S is housed in automatic feeding cassette 40 and is fed sheet by sheet based on the rotation of feeding roller 41. It is then carried to the transfer position while being guided by guide roller 42. Transfer paper S receives the toner image transferred from photosensitive drum 1 at the transfer position by means of the positive electrical field that is discharged from charging wire 32 of transfer unit 30. After the transfer, transfer paper S undergoes toner fusing by means of fusing unit 45 and then ejected onto tray 46.

(Transfer Unit Control Circuit)

Figure 2:
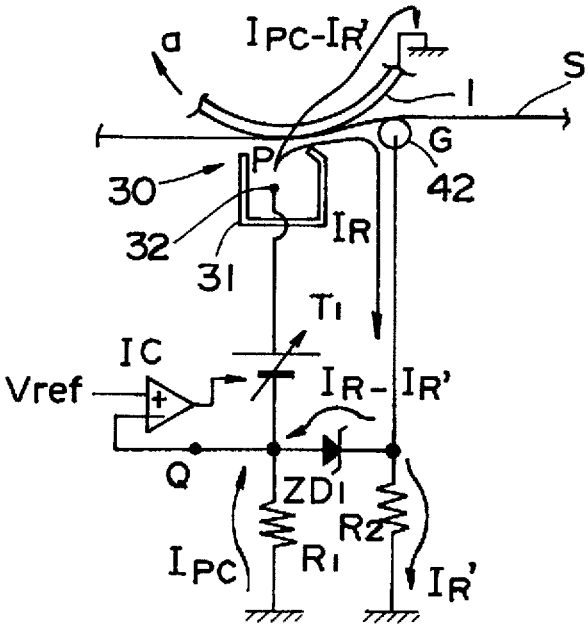
FIG. 2 is a circuit diagram showing a first embodiment of the transfer control in said laser printer.

(First embodiment, see FIG. 2)

In the transfer process described above, electric current flows through grounded photosensitive drum 1 via transfer paper S due to the electrical field that was generated by charging wire 32, as shown in FIG. 2. In an environment where the humidity is normal or low, transfer paper S has high resistance, and therefore this electric current is quite small and the electric field works to attract the toner toward transfer paper S. However, in a high humidity environment, the resistance of transfer paper S decreases because the paper absorbs moisture, whereupon the leakage of transfer current increases and transfer defects occur.

Therefore, in this first embodiment, guide roller 42 is formed of a conductive material. Guide roller 42 is grounded via resistor $R_2$ (having a high resistance of around 30MΩ). It is also connected to the feedback side of power source $T_1$ via constant voltage element (Zener diode) $ZD_1$. The feedback side of power source $T_1$ is grounded via resistor $R_1$ and is also connected to one of the input terminals of comparator IC that controls power source $T_1$.

Comparator IC controls power source $T_1$ in this control circuit such that electric current $I_{PC}$ that flows through resistor $R_1$ will become constant in principle, or in other words, such that the voltage at point Q will be constant. Leaked current $I_R$ that flows to guide roller 42 (point G) via the back side (point P) of transfer paper S from charging wire 32 normally flows toward the ground via resistor $R_2$. When this takes place, electric current $I_{R'}$ that flows toward the ground is equal to leaked current $I_R$, and the transfer current is expressed as $I_{PC}-I_{R'}$. Resistor $R_2$ has a resistance of approximately 30MΩ, and when leaked current $I_R$ reaches 5 μA, the voltage at point G becomes 150V or higher such that electric current equal to $I_R-I_{R'}$ flows through constant voltage element $ZD_1$. Therefore, if electric current $I_{PC}$ is set to be 10 μA, transfer current $I_{PC}-I_{R'}$ becomes 5 μA only in high humidity, and the potential on the back side of transfer paper S is cut in half as well. The voltage at point G is made constant at 150V.

In other words, the potential on the back side of transfer paper S becomes low in high humidity and the potential of guide roller 42 is maintained at a constant level. Consequently, the potential gradient from the back side of transfer paper S to guide roller 42 (between points P and G) becomes small so that the leakage of electric charge in the direction of the thickness of transfer paper S is prevented. Therefore, not only is a reduction in transfer efficiency prevented, but the problem of transfer defects (blank image phenomenon) is also eliminated.

Where in the transfer paper a transfer defect due to the leakage of electric charge in the direction of the thickness of the transfer paper easily occurs varies depending on the construction or control of the image forming device, i.e., the construction of the transfer unit, image carrier, transfer paper guide member, etc., for example, or the timing of the commencement of the supply of power to the transfer electrode, or the properties of the transfer paper. If the present invention is applied, transfer defects that occur in any area of the transfer paper due to the leakage of electric charge in the direction of the thickness of the transfer paper can be eliminated regardless of the construction or control of the image forming device.

Figure 3:
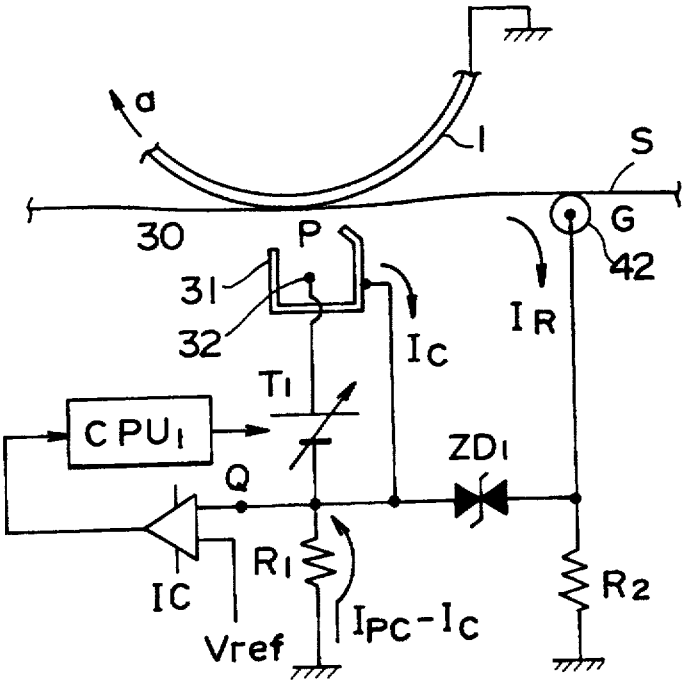
FIG. 3 is a circuit diagram showing a second embodiment of the transfer control in said laser printer.

(Second embodiment, see FIG. 3)

In this second embodiment, shielding plate 31 of transfer unit 30 is connected to the feedback side of power source $T_1$. In addition, in order to control the output of power source $T_1$, the signals output from comparator IC are input to microcomputer CPU1 such that microcomputer CPU1 will control power source $T_1$ based on said signals, instead of controlling power source $T_1$ directly using the signals from comparator IC. The construction of the second embodiment is otherwise the same as that of the first embodiment shown in FIG. 2. Electric current $I_C$ flows to the feedback side of power source $T_1$ from shielding plate 31 so that the electric current that flows through resistor $R_1$ will become $I_{PC}-I_C$.

In this second embodiment, since electric current IC that flows from shielding plate 31 is added for the purpose of controlling the output of power source $T_1$, the voltage at point Q is made constant with increased accuracy.

Figure 4A:
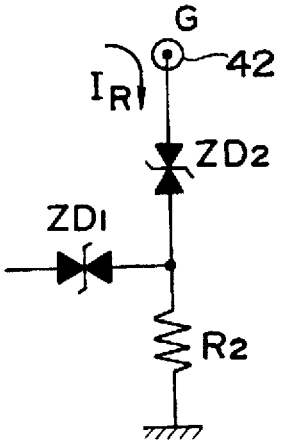
FIG. 4(*a*) is a circuit diagram showing a modified version of the transfer control shown in FIGS. 2 and 3.
Figure 4B:
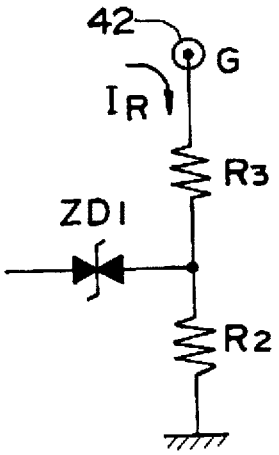

(Modified versions of the first and second embodiments, see FIGS. 4(*a*) and 4(*b*))

FIG. 4(*a*) shows an example in which Zener diode $ZD_2$ is inserted in the rear part of guide roller 42, and FIG. 4(*b*) shows an example in which resistor R3 is inserted in place of Zener diode $ZD_2$ shown in FIG. 4(*a*). If leaked current $I_R$ is large, a high output transformer will be needed as power source $T_1$. However, if the construction is as shown in FIG. 4(*a*) or 4(*b*), a high output transformer is made unnecessary by controlling by means of Zener diode $ZD_2$ or resistor $R_3$ the electric current that flows into the feedback side.

Figure 5:
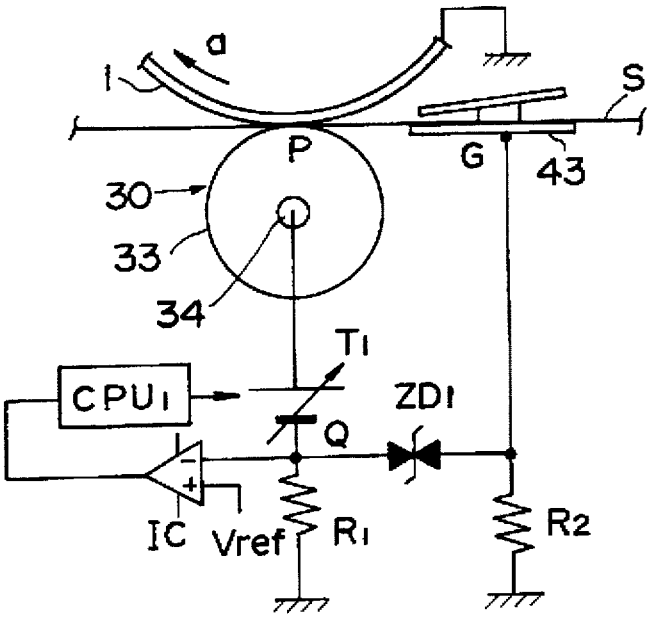
FIG. 5 is a circuit diagram showing a third embodiment of the transfer control in said laser printer.

(Third embodiment, see FIG. 5)

This transfer unit 30 comprises conductive shaft 34 and roller 33 that is made of a conductive elastic material and is located around said shaft. Transfer unit 30 is situated such that it is rotatable. Transfer charge is provided to transfer paper S by roller 33 instead of charging wire 32 described above. Guide plate 43 is used as the guide member for transfer paper S instead of guide roller 42 described above. In this third embodiment as well as in the second embodiment, microcomputer CPU1 controls power source $T_1$. Its construction is otherwise the same as that of the first embodiment shown in FIG. 2, as are the construction and operation of the feedback circuit.

Figure 6:
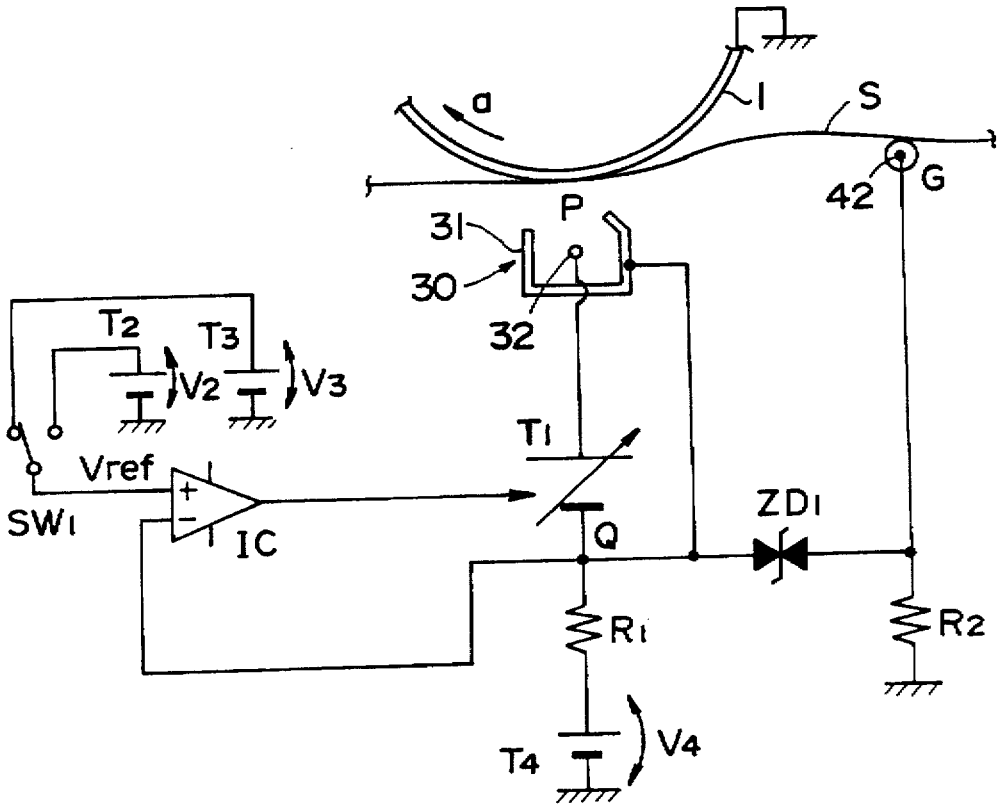
FIG. 6 is a circuit diagram showing a fourth embodiment of the transfer control in said laser printer.

(Fourth embodiment, see FIG. 6)

In this fourth embodiment, reference voltage $V_{ref}$ input to the positive terminal of comparator IC can be changed by means of switch $SW_1$. Switch $SW_1$ selectively alternates the power source between power source $T_2$ having voltage $V_2$ and power source $T_3$ having voltage $V_3$. In addition, power source $T_4$ having voltage $V_4$ is inserted between resistor $R_1$ on the feedback side of power source $T_1$ and the ground. By alternating the power source by means of switch $SW_1$, the transfer current can be adjusted to an amount in accordance with voltage $V_2$ or $V_3$. The adjustment of the transfer current is performed in response to the size and type of transfer paper S or the ambient humidity.

Figure 7:
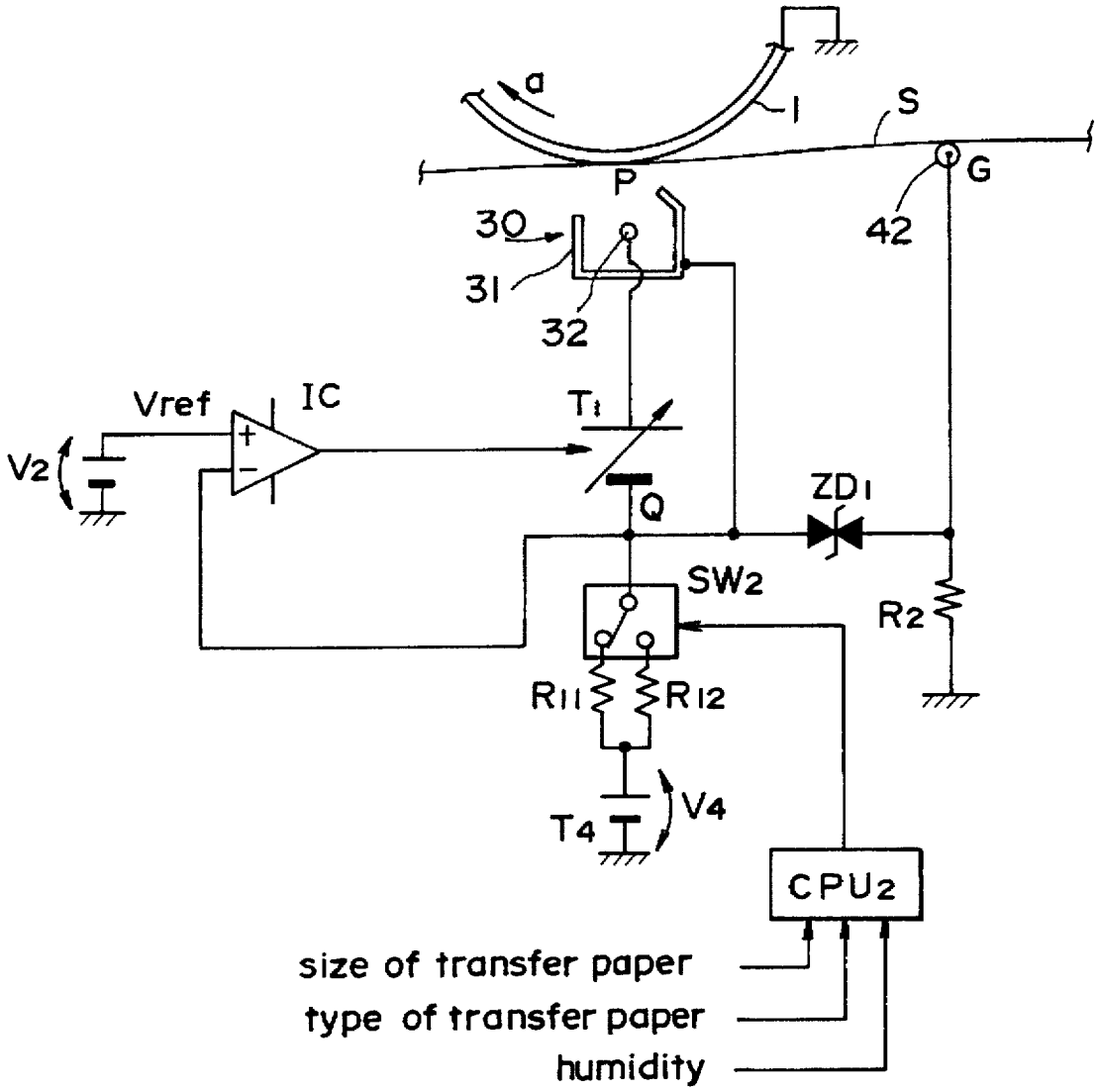
FIG. 7 is a circuit diagram showing a fifth embodiment of the transfer control in said laser printer.

(Fifth embodiment, see FIG. 7)

In this fifth embodiment, switch $SW_2$ that alternates between resistor $R_{11}$ and resistor $R_{12}$ is placed at point Q on the feedback side of power source $T_1$, and this switch $SW_2$ is controlled by microcomputer CPU2. Microcomputer CPU2 controls switch $SW_2$ in response to information such as the size and type of transfer paper S or the ambient humidity, and alternates between resistor $R_{11}$ and resistor $R_{12}$. The transfer current is adjusted in response to the resistance of resistor $R_{11}$ or resistor $R_{12}$.

Figure 8:
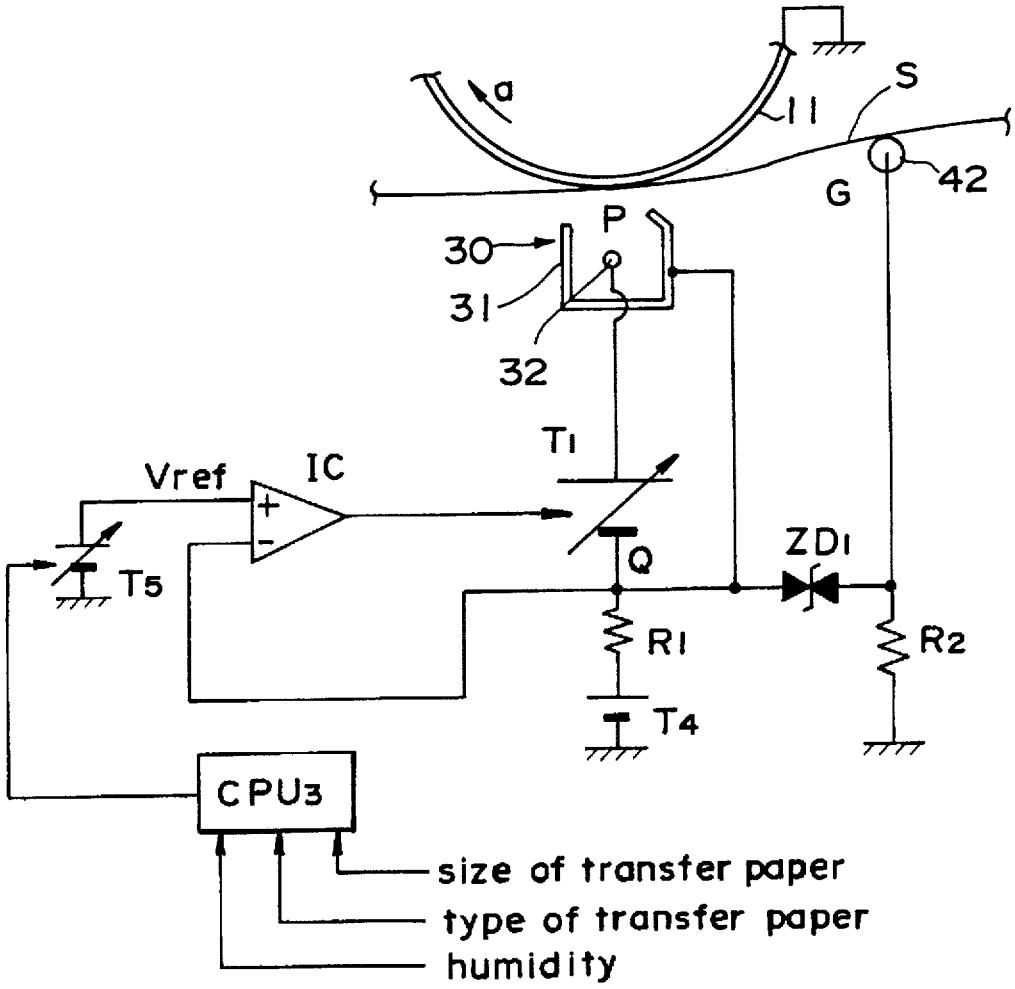
FIG. 8 is a circuit diagram showing a sixth embodiment of the transfer control in said laser printer.

(Sixth embodiment, see FIG. 8)

In this sixth embodiment, the voltage of power source $T_5$ that applies reference voltage Vref that is input to the positive terminal of comparator IC is controlled by microcomputer CPU3. Microcomputer CPU3 changes the output voltage of power source $T_5$ in response to the size and type of transfer paper S or the ambient humidity. In this way, the transfer current is adjusted in the same way as in the fourth and fifth embodiments.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming device for transferring a toner image formed on an image carrier onto a transfer medium which is in close contact with the image carrier comprising:

a guide member for guiding the transfer medium toward a transfer position of the image carrier, a transfer unit for charging the transfer medium guided to the transfer position, a power source which supplies power to the transfer unit, a feedback circuit for controlling the output of the power source so as to maintain at a constant value the amount of electric current obtained by excluding the amount of electric current that flowing to the guide member from the electric current that flowing from the transfer unit to the transfer medium will be constant, and;

said feedback circuit having a circuit which splits the electric current flowing from the guide member and routes it toward a grounded high resistance element and a constant voltage element connected to the feedback side of the power source.

2. The image forming device as claimed in claim 1, wherein the transfer unit has a charging wire to which voltage is applied from the power source and a shielding plate to help the voltage applied to the charging wire to work effectively in the transfer of the toner image.

3. The image forming device as claimed in claim 1, wherein the feedback circuit has a circuit connected with the feedback side of the power source, so that the electric current flowing to the shielding plate is guided to the feedback side of the power source.

4. The image forming device as claimed in claim 1, wherein the feedback circuit has a comparator which compares a reference voltage with the voltage of the feedback side of the power source that fluctuates according to the electric current split from the electric current flowing from the guide member and routed toward the constant voltage element, and controls the voltage applied by the power source based on the output from the comparator.

5. The image forming device as claimed in claim 4, wherein the reference voltage is changeable so as to change the transfer voltage.

6. The image forming device as claimed in claim 1, further comprising a resistor or a constant voltage element which is inserted between the guide member and the bifurcation point of the feedback circuit.

7. A control method for an image forming apparatus having a guide member for guiding a transfer medium toward a transfer position of an image carrier, a transfer unit for charging the transfer medium guided to the transfer position, a power source which supplies power to the transfer unit, the control method comprising the following steps of:

splitting the electric current flowing to the guide member and routing it toward a high resistance element and a constant voltage element, guiding the electrical current flowing the constant voltage element to the feedback side of the power source, and controlling the output of the power source so that the voltage of feedback side of the power source, because constant.

8. The control method as claimed in claim 7, further comprising the step of comprising a reference voltage with the voltage of feedback side of the power source which fluctuates in accordance with the voltage flowing the constant voltage element, so that the voltage of the power source is controlled based on the result of the comparison.

* * * * *